US005913095A

United States Patent [19]

Takashima et al.

[11] Patent Number: 5,913,095

[45] Date of Patent: Jun. 15, 1999

[54] IMAGE FORMING APPARATUS

[75] Inventors: Osamu Takashima, Tokyo; Kazuki Suzuki, Saitama; Shizuo Kawamura, Kanagawa; Yuusuke Noguchi, Kanagawa; Eiji Sawamura, Kanagawa; Masahiro Tomita, Kanagawa; Kazuyuki Saitoh, Tokyo, all of Japan

[73] Assignee: Ricoh Company, Ltd., Tokyo, Japan

[21] Appl. No.: 08/917,195

[22] Filed: Aug. 25, 1997

[51] Int. Cl.[6] ..... G03G 21/16

[52] U.S. Cl. ..... 399/125; 399/405; 271/213; 271/218

[58] Field of Search ..... 399/125, 405; 271/207, 213, 218, 220; 248/300, 301, 450, 451

[56] References Cited

U.S. PATENT DOCUMENTS

| | | | |
|---|---|---|---|
| 5,118,093 | 6/1992 | Makiura et al. | 271/213 |
| 5,400,123 | 3/1995 | Sato et al. . | |
| 5,494,364 | 2/1996 | Murakami et al. | 271/213 |
| 5,602,651 | 2/1997 | Tabata et al. . | |

FOREIGN PATENT DOCUMENTS

| | | |
|---|---|---|
| 55-147340 | 10/1980 | Japan . |
| 58-110655 | 7/1983 | Japan . |
| 60-122946 | 8/1985 | Japan . |
| 62-43360 | 3/1987 | Japan . |
| 1-156160 | 10/1989 | Japan . |
| 1-271362 | 10/1989 | Japan . |
| 4-182260 | 6/1992 | Japan . |
| 4-277157 | 10/1992 | Japan . |

*Primary Examiner*—Sandra Brase
*Assistant Examiner*—William A. Noe
*Attorney, Agent, or Firm*—Oblon, Spivak, McClelland, Maier & Neustadt, P.C.

[57] ABSTRACT

An image forming apparatus including a paper cassette loaded with a stack of papers and a paper stacking device for stacking papers carrying images thereon is disclosed. The apparatus has an upper casing part rotatable away from a lower casing part. When the upper casing part is rotated away from the lower casing part, the apparatus successfully prevents the upper casing part from interfering with a tray or similar paper stacking means and prevents papers stacked on the tray from dropping without having its overall length increased. The tray is arranged in the rear portion of the apparatus opposite to the front portion where a control panel is located, thereby reducing the widthwise dimension of the apparatus. Even in such a position, the tray allows papers stacked thereon to be easily picked up.

14 Claims, 7 Drawing Sheets

IMAGE FORMING APPARATUS

BACKGROUND OF THE INVENTION

The present invention relates to a copier, printer or similar image forming apparatus of the type including a paper cassette loaded with a stack of papers and a tray or similar paper stacking means for stacking the papers sequentially driven out via a paper outlet formed in the casing of the apparatus.

It is a common practice with a copier, optical printer or similar electrophotographic image forming apparatus to mount a cassette in an opening formed in the casing of the apparatus or within the casing. An image forming section included in the apparatus forms a toner image on the paper fed from the cassette. The paper with the image is driven out onto, e.g., a tray.

An image forming apparatus whose casing is made up of a lower casing part and an upper casing part rotatable, or openable, away from the lower casing part is conventional. The problem with this kind of apparatus is that when the upper casing part is opened, it interferes with the tray or similar paper stacking means or causes papers stacked on the tray to drop. To solve this problem, the overall length, particularly widthwise length, of the entire apparatus must be increased, obstructing miniaturization.

On the other hand, it has been customary with an ordinary type of image forming apparatus to arrange a control panel including various keys on the front of the apparatus, and to mount a tray (paper stacking means) on one side of the apparatus in a slightly inclined position. However, the tray mounted on the side of the apparatus in such a position protrudes from the apparatus and increases the overall widthwise dimension of the apparatus. This kind of apparatus is therefore not feasible for a narrow space application.

To promote space saving, the widthwise dimension of the apparatus may be reduced, and the tray may be mounted on the rear of the apparatus opposite to the front. This kind of scheme, however, brings about the following problems. The papers carrying images thereon are driven out to the rear of the apparatus in a slightly upwardly inclined position. This makes it difficult for the operator to pick up the papers because the papers are remote from the operator.

Technologies relating to the present invention are disclosed in Japanese Patent Laid-Open Publication Nos. 4-277157, 1-271362 and 4-182260 as well a s in Japanese Utility Model Laid-Open Publication Nos. 62-43360, 1-156160, 55-147340, 60-122946, and 58-110655.

SUMMARY OF THE INVENTION

It is therefore a first object of the present invention to provide an image forming apparatus of the type having an upper casing part openable away from a lower casing part, and capable of preventing the upper casing part from interfering with a tray or similar paper stacking means and preventing papers stacked on the tray from dropping when said upper casing part is opened.

It is a second object of the present invention to provide an image forming apparatus including a tray or similar paper stacking means arranged in a rear portion opposite to a front portion, where an operation panel is arranged, in order to reduce the widthwise dimension of the apparatus, yet allowing the operator to pick up papers easily from the tray.

In accordance with the present invention, an image forming apparatus inlcudes a casing made up of a lower casing part and an upper casing part rotatable about a fulcrum toward and away from the lower casing part. A paper stacking device has a paper stacking device extending over the upper casing part and lower casing part. The paper stacking device has a paper stacking surface adjoining the fulcrum and is positioned such that the leading edge portion of the paper stacking surface in the direction of paper discharge is held in a substantially upright position.

Also, in accordance with the present invention, an image forming apparatus capable of discharging a paper carrying an image thereon to the rear portion of a casing thereof includes a paper cassette for feeding a paper for forming an image. A paper stacking device is arranged in the casing in a substantially upright position for stacking the paper discharged to the rear portion of the casing. An opening is formed in the casing such that the upper edge portion of the paper stacked on the paper stacking device protrudes from the top of said casing. The length between the lower edge of the paper stacking device and the opening is smaller than the length of the paper, as measured in the direction of paper discharge, usually fed from the paper cassette.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Preferred embodiments of the image forming apparatus in accordance with the present invention will be described hereinafter.

1st Embodiment

Figure 1:
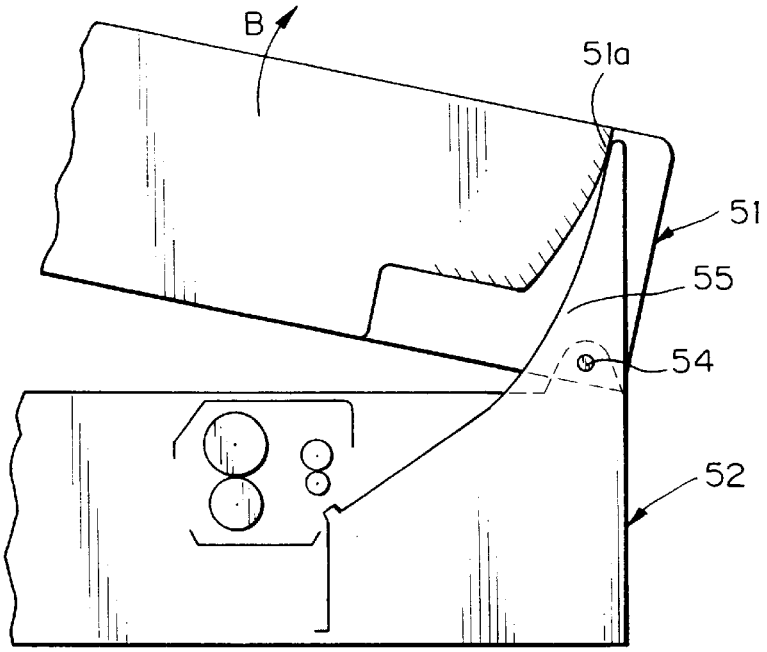
Fig. 1 PRIOR ART
FIG. 1 shows a conventional image forming apparatus of the type having an upper casing part openable away from a lower casing part, and demonstrates an occurrence that the upper casing part contacts a paper discharge tray when the tray is affixed to the lower casing part.
Figure 2:
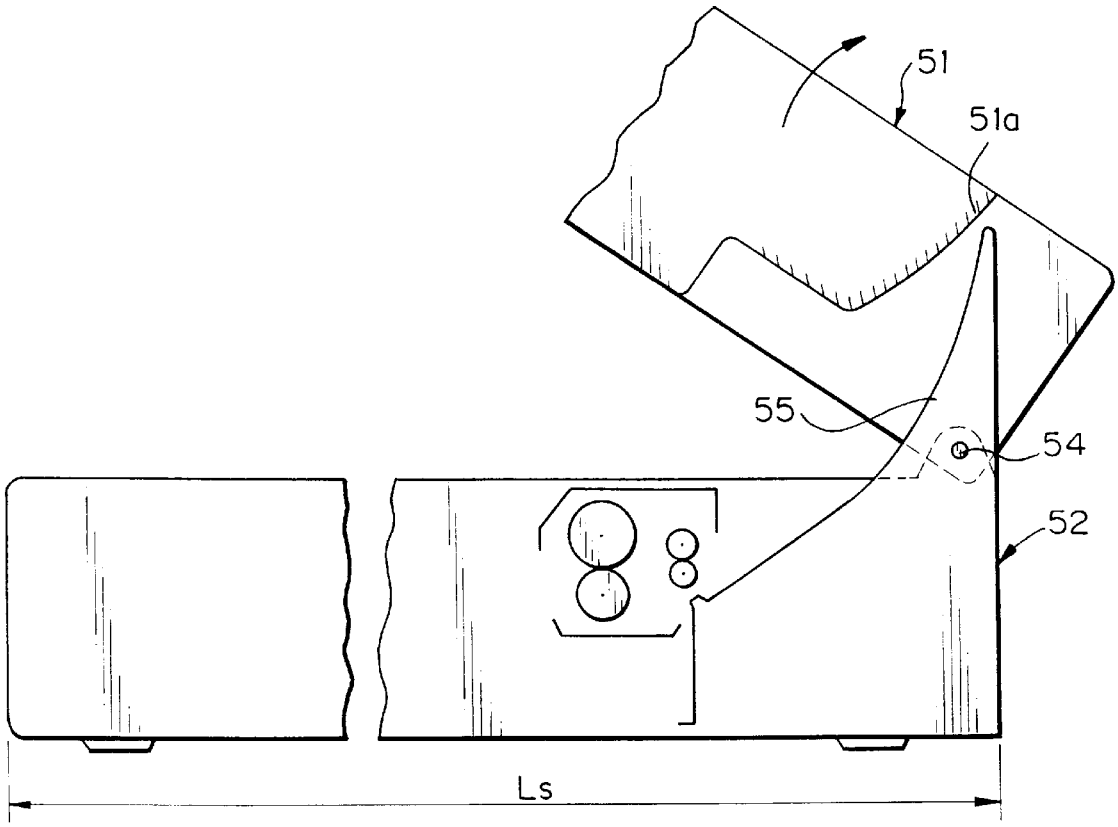
Fig. 2 PRIOR ART
FIG. 2 shows a problem that the overall length of the apparatus shown in FIG. 1 increases when the tray is shifted to the rear in order to solve the above problem.

This embodiment relates to an image forming apparatus capable of achieving the first object mentioned earlier. To better understand the illustrative embodiment, brief reference will be made to a conventional image forming apparatus of the type having an upper casing part capable of being opened away from a lower casing part, shown in FIG. 1. As shown, an upper casing part 51 is rotatable about a shaft 54 toward and away from a lower casing part 52. A paper discharge tray or paper stacking means 55 is affixed to the lower casing part 52 while extending over the upper and lower casing parts 51 and 52. This brings about a problem that when the upper casing part 51 is opened in a direction indicated by an arrow B, a part 51*a* of the casing part 51 contacts the top of the tray 55 and prevents the casing part 51 to be sufficiently opened. FIG. 2 shows a conventional solution to this problem. As shown, the tray 55 is shifted to the rear (right as viewed in FIG. 2) such that the part 51*a* of the upper casing part 51 does not interfere with the tray 55. However, the position of the tray 55 shown in FIG. 2 increases the overall length Ls and therefore overall size of the apparatus.

Figure 3:
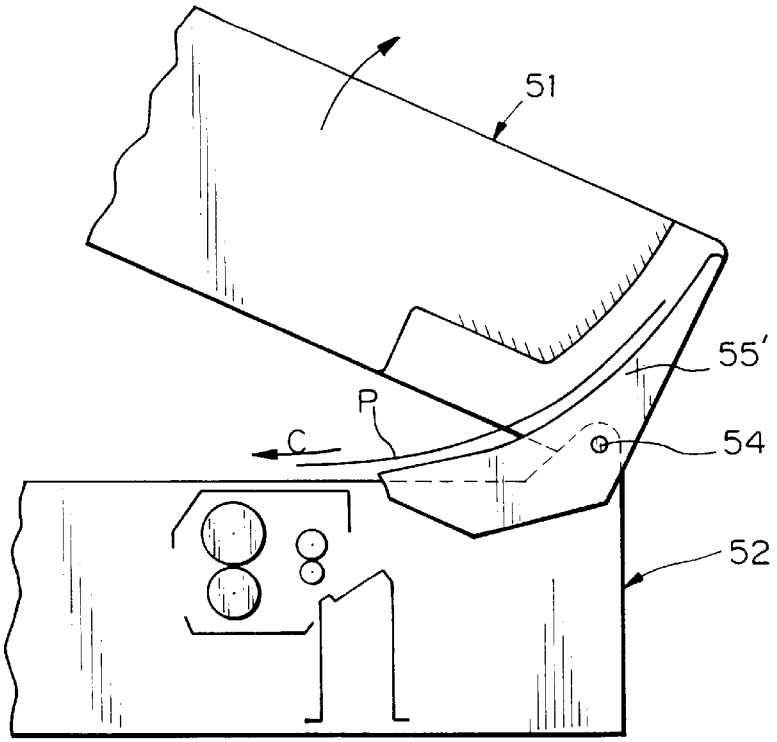
Fig. 3 PRIOR ART
FIG. 3 shows a problem to occur when the tray is affixed to the upper casing part.

FIG. 3 shows another conventional configuration in which a paper discharge tray 55' is affixed to the upper casing part 51. This configuration has a problem that when the upper casing part 51 is opened, papers P stacked on the tray 55' are raised. As a result, the papers P are shifted in a direction indicated by an arrow C during the movement of the casing part 51 and dropped from the tray 55'.

Figure 4:
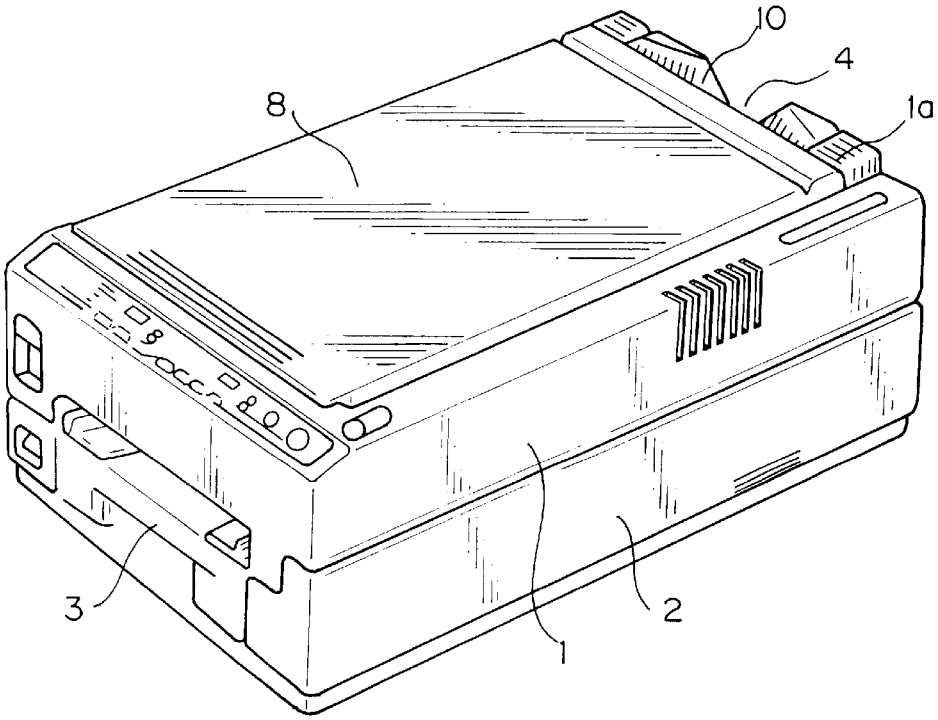
FIG. 4 is a perspective view showing the appearance of a first embodiment of the image forming apparatus in accordance with the present invention.
Figure 5:
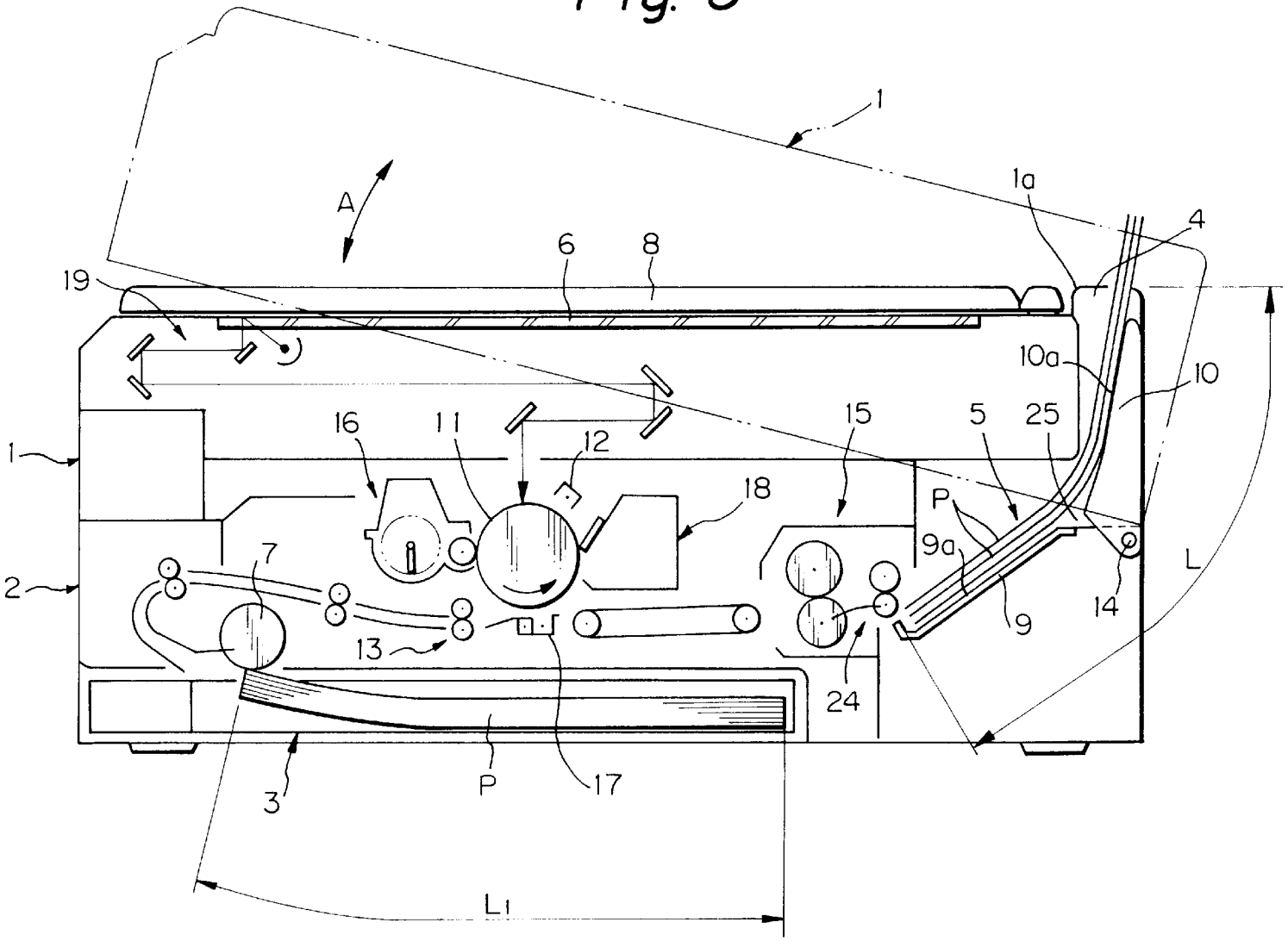
FIG. 5 is an elevation showing the overall arrangement of the first embodiment.
Figure 6:
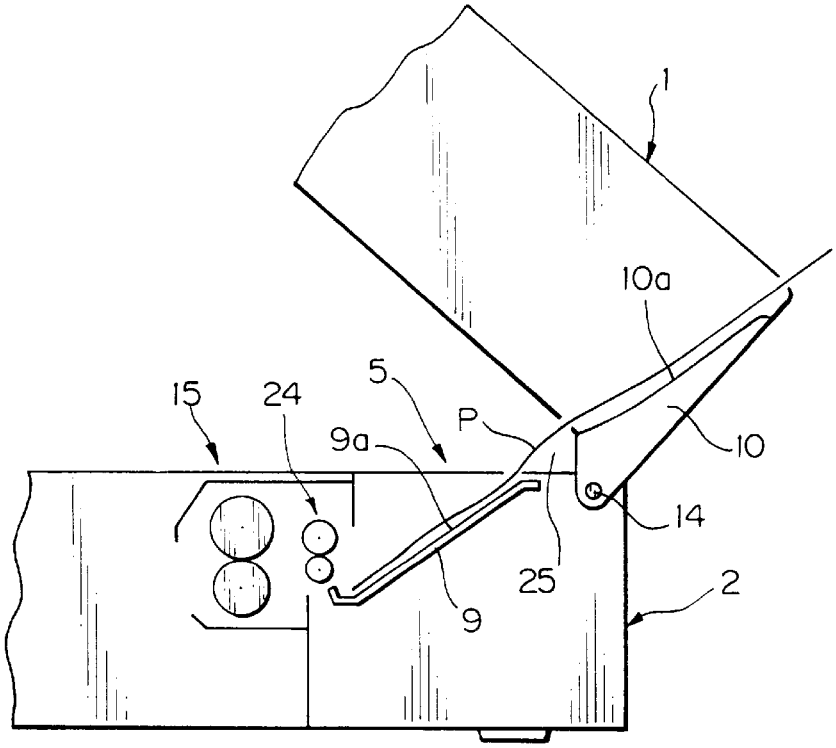
FIG. 6 shows the first embodiment in a condition wherein an upper casing part is opened.

Referring to FIGS. 4, 5 and 6, an image forming apparatus embodying the present invention is shown and implemented as a copier by way of example. As shown, the copier is divided into an upper casing part 1 and a lower casing part 2. The upper casing part 1 is rotatable about a shaft 14 relative to the lower casing part 2 between a position indicated by a phantom line and a position indicated by a solid line. A paper discharge tray or paper stacking means 5 is positioned in the rear portion (right portion as viewed in the figures) of the copier. A paper P is fed from a paper cassette 3. After an image has been formed on the paper P, a discharge roller pair 24 drives the paper P onto the paper discharge tray 5.

The paper discharge tray 5 is made up of a lower tray 9 affixed to the lower casing part 2 and an upper tray 10 affixed to the upper casing part 1. The upper and lower trays 9 and 10 respectively have stacking surfaces 9*a* and 10*a* separate from each other at a position 25 adjoining the shaft 14. As shown in FIG. 5, when the upper casing part 1 is closed, i.e., rests on the top of the lower casing part 2, the stacking surface 10*a* of the upper tray 10 is in a substantially upright position.

The upper casing part 1 is formed with an opening 4 allowing the upper edge portion of the paper P stacked on the tray 5 to protrude from the top 1*a* of the casing part 1. In this configuration, a length L between the lower edge of the lower tray 9 and the opening 4 is smaller than the length L1 of the paper 1 usually fed from the paper cassette 3, as measured in the paper feed direction.

As shown in FIG. 5, a photoconductive element in the form of a drum 11 is positioned substantially at the center of the copier. Arranged around the drum 11 are a main charger 12, a developing unit 16, a transfer and separation charger 17, and a cleaning unit 18.

A document is laid on a glass platen 6 and then pressed by a cover plate 8 from the above. While the document is illuminated, the resulting imagewise reflection from the document is routed through optics 19 to the surface of the drum 11. At this instant, the surface of the drum 11 has been uniformly charged by the main charger 12. As a result, a latent image corresponding to the image of the document is electrostatically formed on the charged surface of the drum 11. The developing unit 16 develops the latent image with toner and thereby produces a corresponding toner image. The papers P of the cassette 3 are sequentially fed out by a pick-up roller 7 which is rotated at a preselected timing. The paper P is once stopped by a registration roller pair 13 and then driven toward a transfer position, where the transfer and separation charger 17 is located, such that the leading edge of the paper P meets the leading edge of the toner image existing on the drum 11.

The toner image is transferred to the upper surface of the paper P, as seen in FIG. 5. The paper P with the toner image is separated from the drum 11 and conveyed toward a fixing unit 15. After the toner image has been fixed on the paper P by the fixing unit 15, the paper P is driven onto the lower tray 9 and upper tray 10 by a discharge roller pair 24. The cleaning unit 18 removes the toner remaining on the drum 11 after the image transfer. Further, a discharge lamp, not shown, dissipates charge also remaining on the drum 11. The drum 11 is now ready to be charged by the main charger 12 again.

In the illustrative embodiment, the papers P each carrying an image thereon are stacked on the tray 5 located in the rear portion of the copier. This successfully reduces the widthwise dimension of the copier and thereby saves space. However, the papers P stacked in the rear portion of the copier are remote from the operator and are difficult to pick up. In light of this, the upper tray 10 of the tray 5 is held in a substantially upright position while the upper edge portion of the paper stack on the tray 5 is allowed to protrude from the top 1*a* of the upper casing part 1. With this configuration, the copier allows the operator to pick up the paper stack easily.

Further, the upper tray 10 and lower tray 9 constituting the tray 5 are affixed to the upper casing part 1 and lower casing part 2, respectively, as stated earlier. Therefore, even if the length of the copier in the depthwise direction (right-and-left direction in FIG. 5) is not increased, the upper casing part 1 can be prevented from interfering with the upper tray or paper stacking means 10. Specifically, when the casing part 1 is opened away from the casing part 2, the upper tray 10 mounted on the casing part 1 rotates about the shaft 14 together with the casing part 1 while the lower tray 9 remains on the casing part 2.

Moreover, the position 25 where the stacking surfaces 9*a* and 10*a* of the tray 5 are separate from each other is located in the vicinity of the shaft 14. Therefore, even when the upper casing part 1 is opened with the papers P stacked on the surfaces 9*a* and 10*a*, as shown in FIG. 6, the lower tray 9 and upper tray 10 do not move away from each other at the position 25. This prevents the papers P from dropping from the tray 5.

As stated above, in the illustrative embodiment, paper stacking means is mounted partly on an upper casing part and partly on a lower casing part. When the upper casing part is opened away from the lower casing part, the part of the paper stacking means mounted on the upper casing part rotates together with the upper casing part about a fulcrum while the other part of the paper stacking means remains on the lower casing part. This prevents the upper casing part from interfering with the paper stacking means without increasing the depthwise length of an image forming apparatus.

In addition, even when the upper casing part is opened with papers stacked on the paper stacking surface, the two parts of the paper stacking means are prevented from moving away from each other at a position where they adjoin each other. It follows that the papers stacked on the paper stacking means are prevented from dropping.

2nd Embodiment

This embodiment relates to an image forming apparatus capable of achieving the second object mentioned earlier.

Figure 7:
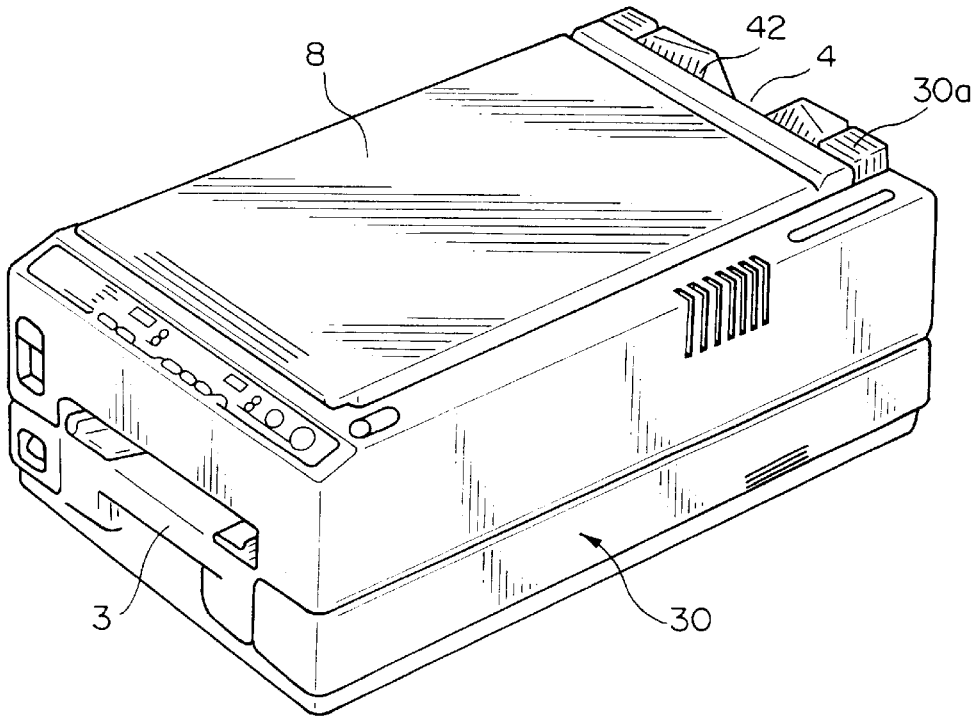
FIG. 7 is a perspective view showing the appearance of a second embodiment of the image forming apparatus in accordance with the present invention.
Figure 8:
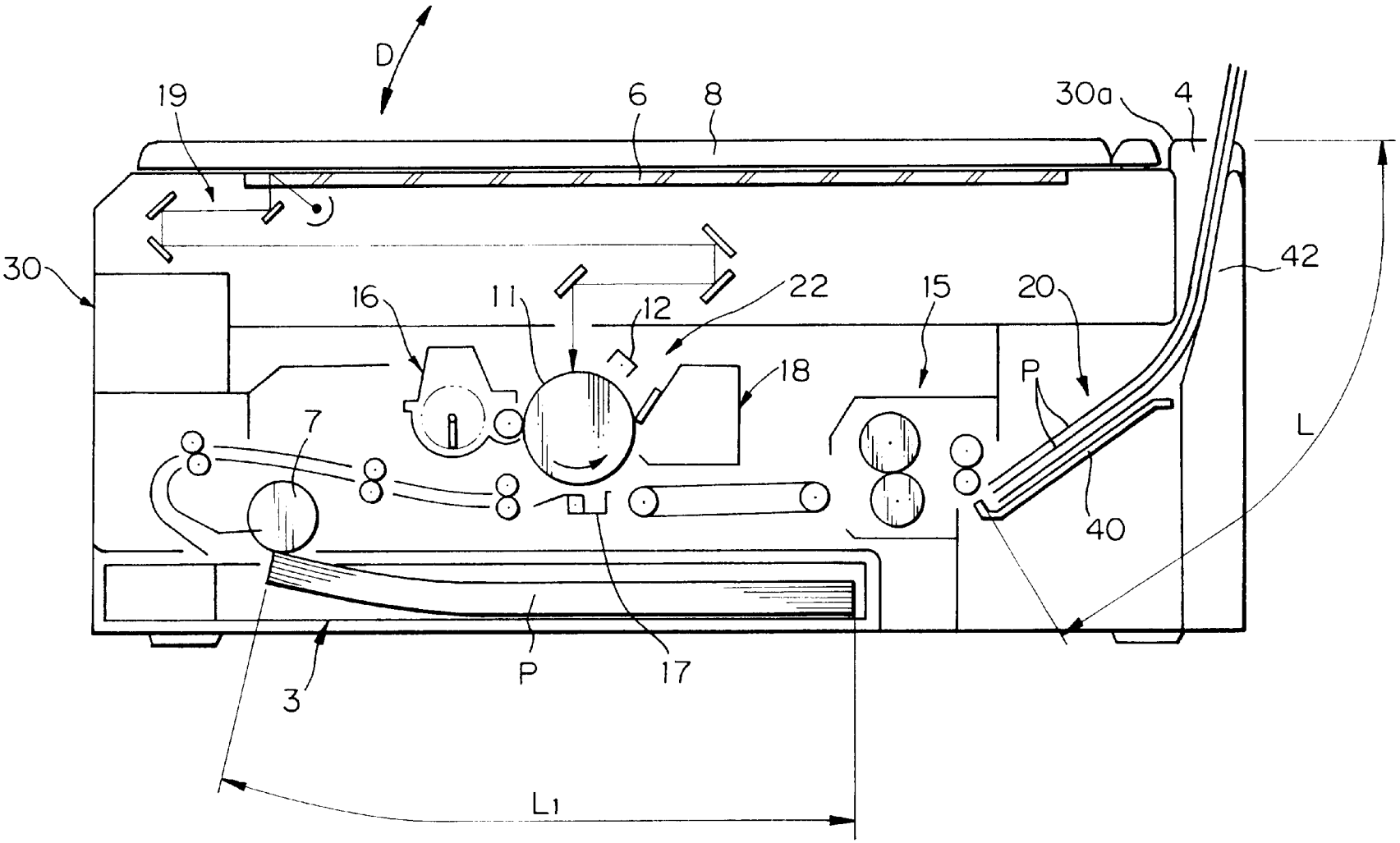
FIG. 8 is an elevation showing the overall arrangement of the second embodiment.

Referring to FIGS. 7 and 8, this embodiment is also implemented as a copier. In FIGS. 7 and 8, the same or similar structural elements as or to the elements shown in FIGS. 4–6 are designated by like reference numerals. As shown, the copier includes a casing 30 having a paper stacking section 20 at its rear portion (right portion as viewed in the figures). The paper P fed from the paper cassette 3 is driven out to the paper stacking section 20 after image formation. Specifically, after an image has been formed on the paper P by an image forming section 22, the paper P is driven out onto paper discharge trays 40 and 42 disposed in the rear portion of the casing 30. The leading edge portion of the paper P stacked on the trays 40 and 42 is held in a substantially upright position, as illustrated. Further, the upper edge portion of the paper P protrudes from the top 30*a* of the casing 30 through the opening 4 formed in the casing 30. As a result, the length L between the lower edge of the tray 40 and the opening 4 is smaller than the length L1 of the paper P, as in the previous embodiment.

The photoconductive drum 11 is positioned in the image forming section 22 arranged in the casing 30. Arranged around the drum 11 are the main charger 12, developing unit 16, transfer and separation charger 17, and cleaning unit 18.

A document is laid on the glass platen 6 and then pressed by the cover plate 8 which is rotatable in a direction indicated by an arrow D. While the document is illuminated, the resulting imagewise reflection from the document is routed through the optics 19 to the surface of the drum 11. At this instant, the surface of the drum 11 has been uniformly charged by the main charger 12. As a result, a latent image corresponding to the image of the document is electrostatically formed on the charged surface of the drum 11. The developing unit 16 develops the latent image with toner and thereby produces a corresponding toner image. The papers P of the cassette 3 are sequentially fed out by the pick-up roller 7 which is rotated at a preselected timing. The paper P is once stopped by the registration roller pair 13 and then driven toward the transfer position, where the transfer and separation charger 17 is located, such that the leading edge of the paper P meets the leading edge of the toner image existing on the drum 11.

The toner image is transferred to the upper surface of the paper P, as seen in FIG. 8. The paper P with the toner image is separated from the drum 11 and conveyed toward the fixing unit 15. After the toner image has been fixed on the paper P by the fixing unit 15, the paper P is driven onto the lower trays 40 and 42. The cleaning unit 18 removes the toner remaining on the drum 11 after the image transfer. Further, the discharge lamp, not shown, dissipates charge also remaining on the drum 11. The drum 11 is now ready to be charged by the main charger 12 again.

In the illustrative embodiment, the papers P each carrying an image thereon are stacked on the paper discharging section 20 located in the rear portion of the casing 30. This successfully reduces the widthwise dimension of the copier and thereby saves space. However, the papers P stacked in the rear portion of the casing 30 are remote from the operator and are difficult to pick up. In light of this, the tray 42 of the paper stacking section 20 is held in a substantially upright position while the upper edge portion of the paper stack on the tray 42 is allowed to protrude from the top 30*a* of the upper casing part 30. With this configuration, the copier allows the operator to pick up the paper stack easily.

Figure 9:
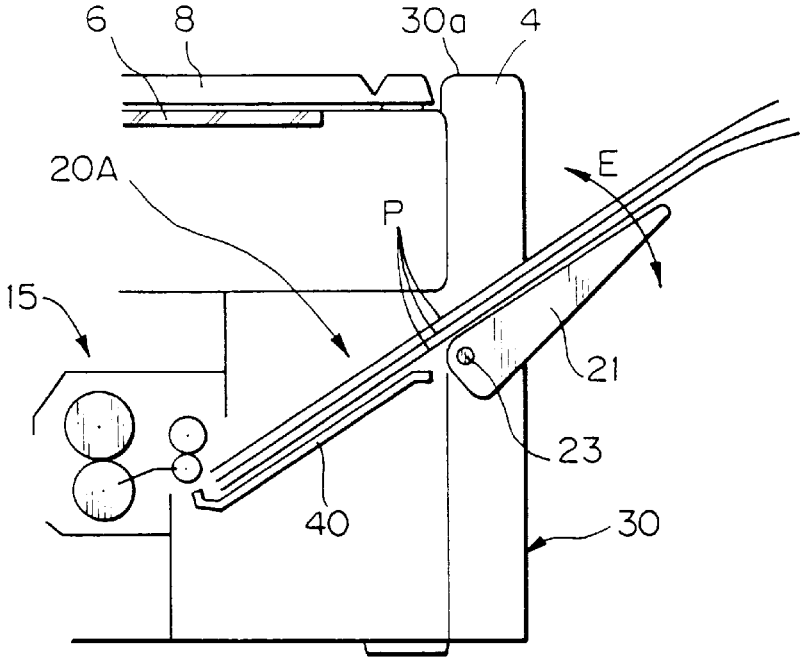
FIG. 9 shows a modification of the second embodiment.

FIG. 9 shows a modification of the second embodiment. In FIG. 9, the same structural elements as the elements shown in FIG. 8 are designated by like reference numerals. As shown, the modification includes a paper stacking section 20A whose leading edge portion in the direction of paper discharge is implemented as a movable tray portion 21. The movable tray portion 21 is rotatable about a shaft 23 relative to the tray or sheet stacking section 40 in a direction indicated by an arrow E. When the papers P to be dealt with are relatively long in the paper discharge direction or easy to collapse, the movable tray portion 21 may be rotated clockwise, as viewed in FIG. 9, about the shaft 23 to the position shown in FIG. 9. This prevents such papers P from collapsing in the paper stacking section 20A.

Figure 10:
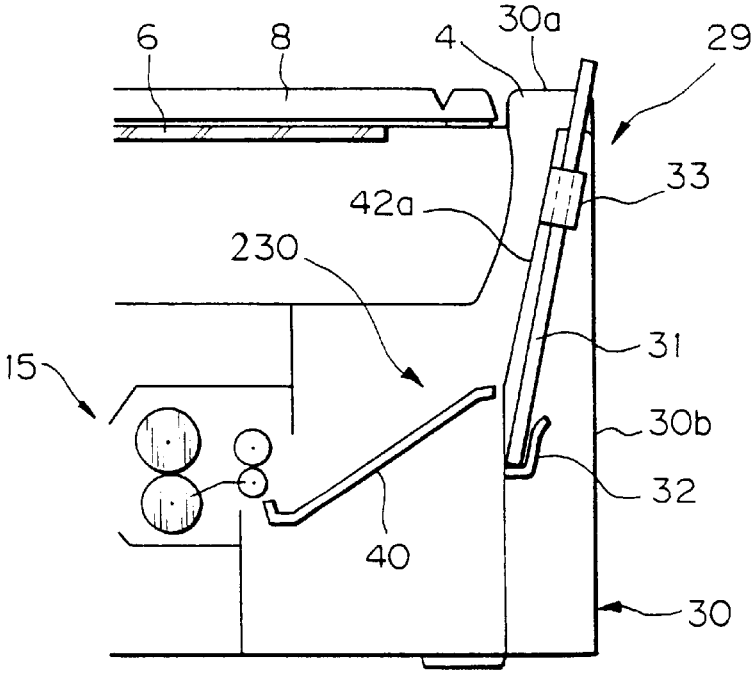
FIG. 10 shows another modification of the second embodiment.
Figure 11:
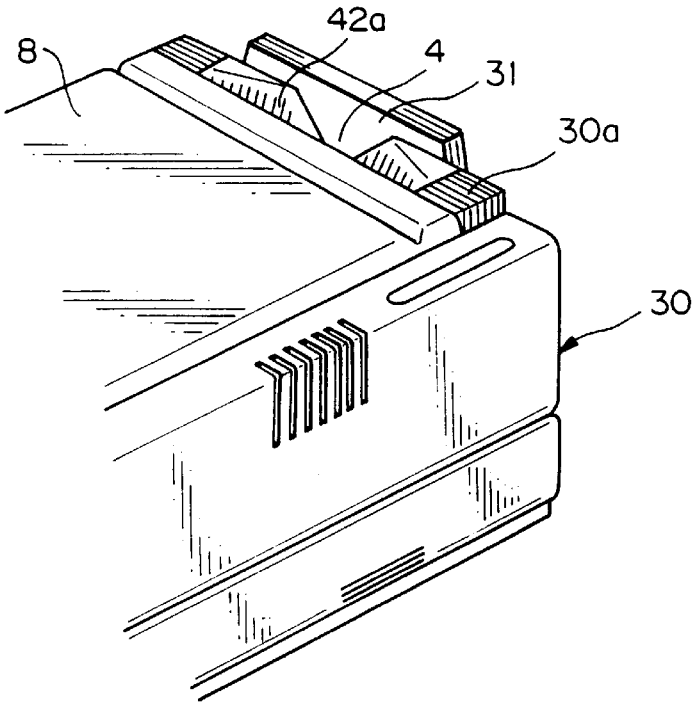
FIG. 11 is a perspective view associated with FIG. 10.

FIGS. 10 and 11 show another modification of the second embodiment. In FIGS. 10 and 11, the same or similar structural elements as the elements shown in FIGS. 7 and 8 are designated by like reference numerals. As shown, the paper stacking section includes a paper discharge tray 42*a*. A rack 29 for receiving an operation manual 31 is provided on the back of the tray 42*a*. The rack 29 is made up of a seat 32 and a bar 33 playing the role of holding members. The seat 32 sustains the bottom of the manual 31. The bar 33 has a generally U-shaped configuration for holding substantially the intermediate portion of the manual 31 in the lengthwise direction of the manual 31. The seat 32 and bar 33 are formed integrally with the tray 42*a* by, e.g., molding of resin. As shown in FIG. 10, the rack 29 is so positioned as not to protrude from the side 30*b* of the casing 30.

In the modification shown in FIGS. 10 and 11, the manual 31 is stored in the rack 29 and therefore prevented from being lost or smeared. In addition, the rack 29 formed integrally with the tray 42*a* is less expensive and more compact than a rack formed in an exclusive portion of the casing 30.

Figure 12:
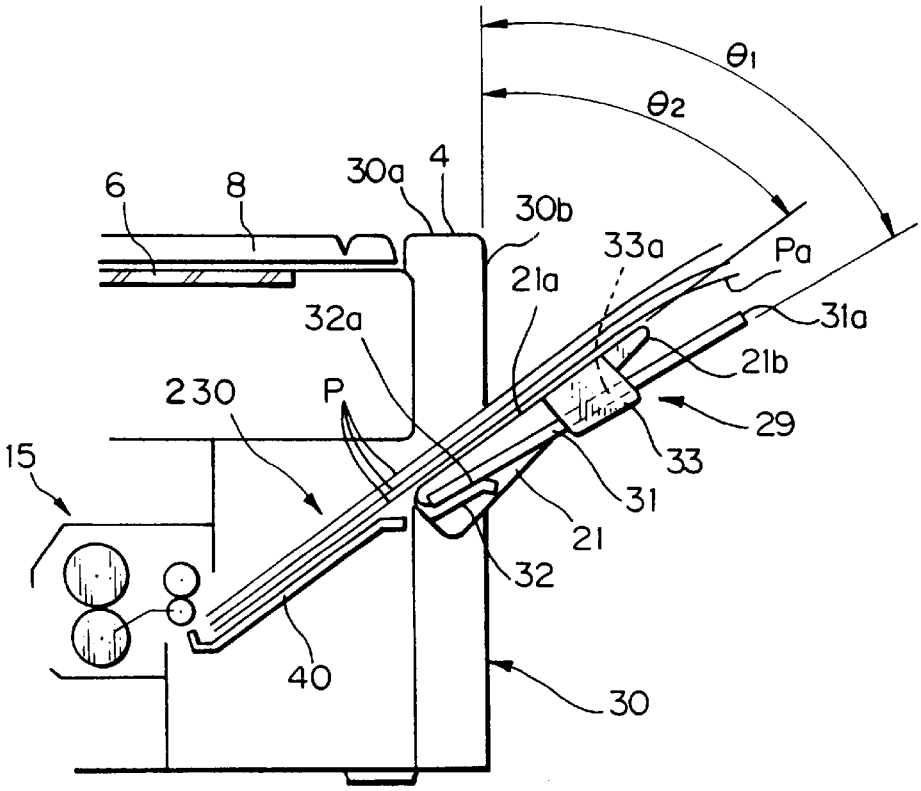
FIG. 12 shows still another modification of the second embodiment.

As shown in FIG. 12, the seat 32 and bar 33 respectively have surfaces 32*a* and 33*a* on which the manual 31 rests. The surfaces 32*a* and 33*a* are inclined by an angle θ1 relative to the side 30*b* of the casing 30. The angle θ1 should preferably greater than an angle θ2 between the surface 21*a* of the movable tray portion 21 for stacking the papers P and the side 30*b* of the casing 30. In this configuration, even when the papers P are stacked on the paper stacking section 230 holding the manual 31 in the rack 29, a broad space is available between the top 31*a* of the manual 31 and the back Pa of the papers P, facilitating the removal of the manual 31.

Further, the top 21*b* of the movable tray portion 21 (or the fixed tray) should preferably be lower in level than the top 31*a* of the manual 31 received in the rack 29. Then, even when the manual 31 is received in the rack 29 provided on the back of the paper stacking section 230, the top 21*b* of the tray portion 21 is lower in level than the top 31*a* of the manual 31. It follows that when no papers P are stacked on the stacking section 230, the manual 31 protrudes upward beyond the top 21*b* of the tray portion 21 and is therefore easy to pick up.

As stated above, despite that a paper discharge tray or similar paper stacking means is provided in the rear portion of a casing in order to reduce the widthwise dimension of an apparatus, the illustrative embodiment allows papers to be stacked on the stacking means held in a substantially upright position. This, coupled with the fact that the upper edge portion of the paper stack protrudes from an opening formed in the casing, facilitates the removal of the paper stack.

When the papers to be discharged onto the paper stacking means are relatively long in the paper discharge direction or easy to collapse, a portion of the stacking means variable in angle is angularly moved toward the horizontal in order to prevent the papers from collapsing.

An operation manual can be stored in a rack and therefore prevented from being lost or smeared. The rack is less expensive than an exclusive manual storing portion. In addition, the rack reduces the overall dimensions of the apparatus. Further, even when papers are stacked on the stacking means holding the manual in its rack, a space broad enough to facilitate the removal of the manual is available between the top of the manual and the back of the stacking means.

Even when the manual is received in the rack provided on the back of the stacking section, the top of the stacking means is lower in level than the top of the manual. It follows that when no papers are stacked on the stacking means, the manual protrudes upward beyond the top of the stacking means and is therefore easy to pick up.

Various modifications will become possible for those skilled in the art after receiving the teachings of the present disclosure without departing from the scope thereof.

What is claimed is:

1. An image forming apparatus comprising:

a casing comprising a lower casing part and an upper casing part rotatable about a fulcrum toward and away from said lower casing part; and a paper stacking device comprising paper stacking means for stacking a paper in the casing so that the paper extends out from said upper casing part and said lower casing part, said paper stacking means having a paper stacking surface adjoining said fulcrum and being positioned such that a leading edge portion of said paper stacking surface in a direction of paper discharge is held in a substantially upright position.

2. An apparatus as claimed in claim 1, wherein said paper stacking means is arranged partly on said upper casing part and partly on said lower casing part.

3. An apparatus as claimed in claim 2, further comprising an opening formed in said upper casing part such that an upper edge portion of a paper stacked on said paper stacking means protrudes from a top of said upper casing part.

4. An apparatus as claimed in claim 3, further comprising a paper cassette loaded with a stack of papers, wherein a distance between a length between a lower edge of said paper stacking means and said opening is smaller than a length of the paper, as measured in a direction of paper discharge, usually fed from said paper cassette.

5. An image forming apparatus comprising:

a casing having an upper part that is rotatably connected to a lower part of the casing;

a paper cassette for feeding a paper for forming an image thereon;

paper stacking means arranged in said casing in a substantially upright position for stacking the paper discharged to a rear portion of said casing; and an opening formed in said casing such that an upper edge portion of the paper stacked on said paper stacking means protrudes from the upper part of said casing while a lower edge portion of the paper remains in said lower part of said casing;

wherein a length between a lower edge of said paper stacking means and said opening is smaller than a length of the paper, as measured in a direction of paper discharge, usually fed from said paper cassette.

6. An apparatus as claimed in claim 5, wherein a part of said paper stacking means in a direction of paper discharge is variable in angle relative to the other portion of said paper stacking means.

7. An apparatus as claimed in claim 6, further comprising holding members provided on a back of said paper stacking means for holding an operation manual.

8. An apparatus as claimed in claim 7, wherein a top of said paper stacking means is lower in level than a top of the operation manual held by said holding members.

9. An apparatus as claimed in claim 7, wherein an angle between surfaces of said holding members for supporting the operation manual and a rear outside surface of said casing is greater than an angle between a paper stacking surface of said paper stacking means and said rear outside surface.

10. An apparatus as claimed in claim 9, wherein a top of said paper stacking means is lower in level than a top of the operation manual held by said holding members.

11. An apparatus as claimed in claim 5, further comprising holding members provided on a back of said paper stacking means for holding an operation manual.

12. An apparatus as claimed in claim 11, wherein a top of said paper stacking means is lower in level than a top of the operation manual held by said holding members.

13. An apparatus as claimed in claim 11, wherein an angle between surfaces of said holding members for supporting the operation manual and a rear outside surface of said casing is greater than an angle between a paper stacking surface of said paper stacking means and said rear outside surface.

14. An apparatus as claimed in claim 13, wherein a top of said paper stacking means is lower in level than a top of the operation manual held by said holding members.

* * * * *